United States Patent [19]

Reiss et al.

[11] Patent Number: 4,586,277

[45] Date of Patent: May 6, 1986

[54] STEAM IRON WITH PRESSURE EQUALIZATION APPARATUS

[75] Inventors: Gerald Reiss, Heusenstamm; Gerd Henneberger, Frankfurt, both of Fed. Rep. of Germany

[73] Assignee: Rowenta-Werke, GmbH, Fed. Rep. of Germany

[21] Appl. No.: 765,896

[22] Filed: Aug. 14, 1985

[30] Foreign Application Priority Data

Aug. 16, 1984 [DE] Fed. Rep. of Germany ..... 3430120

[51] Int. Cl.[4] ..... D06F 75/18

[52] U.S. Cl. ..... 38/77.81; 38/77.83

[58] Field of Search ..... 38/77.7, 77.8, 77.81, 38/77.82, 77.83, 77.9, 85

[56] References Cited

U.S. PATENT DOCUMENTS 3,114,983 12/1963 Larcher ..... 38/77.83
4,079,528 3/1978 Lindstaedt et al. ..... 38/77.83
4,550,514 11/1985 Reiss et al. ..... 38/77.81

FOREIGN PATENT DOCUMENTS 222199 5/1983 Japan ..... 38/77.7
2043706 10/1980 United Kingdom ..... 38/77.83
2065176 6/1981 United Kingdom ..... 38/77.82

*Primary Examiner*—Werner H. Schroeder
*Assistant Examiner*—Andrew M. Falik
*Attorney, Agent, or Firm*—Neil M. Rose; Clifford A. Dean

[57] ABSTRACT

A steam iron has a water storage tank, an evaporation chamber to provide steam for ironing, and a drip valve for regulating the flow of water from the tank into the evaporation chamber. A pressure chamber in the tank is connected to the evaporation chamber via a pressure equalization passage. The pressure chamber is also connected to receive water from the tank via a non-return valve and is connected to feed water to said evaporation chamber via said drip valve.

4 Claims, 1 Drawing Figure

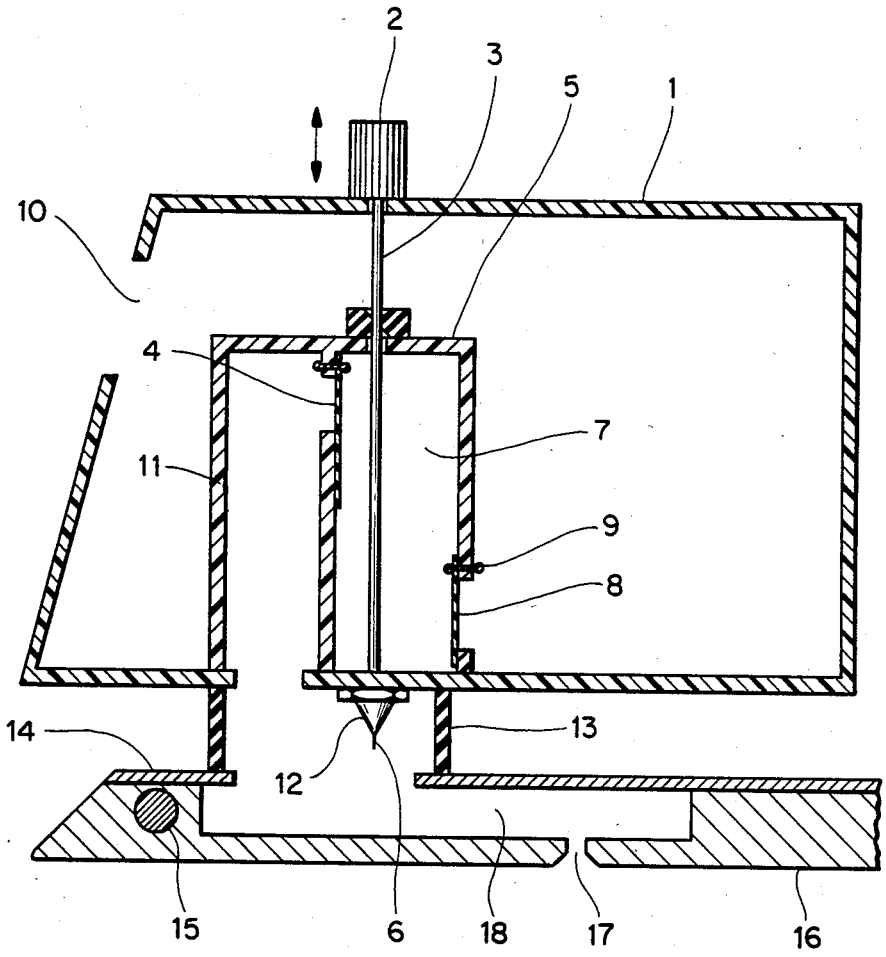
2
3
5
1
10
4
7
11
9
8
14
13
12
15
6
18
17
16

STEAM IRON WITH PRESSURE EQUALIZATION APPARATUS

BACKGROUND OF THE INVENTION

The invention relates to a steam iron having a water storage tank, an evaporation chamber to provide steam for ironing, and a drip valve for regulating the flow of water from the tank into the evaporation chamber.

Steam irons of this type have long been known. They may be used either as dry irons or as steam irons, as desired. For steam ironing, a metered quantity of water is fed from the tank into the evaporation chamber provided in the soleplate of the iron via the drip valve. As the hydrostatic pressure of the column of water in the water storage tank bearing on the valve is reduced, the quantity of steam produced in the evaporation chamber and escaping through the soleplate falls sharply over a certain period of time. In addition, during the steam ironing operation, pressure is built up in the evaporation chamber which affects the quantity of water flowing out of the drip valve. In order to equalize the pressure different in the chamber and in the interior of the tank, it has been proposed that the tank and the evaporation chamber be connected to each other by a pressure equalization tube (DE-AS 19 31 847). With this type of pressure equalization, steam flows out of the evaporation chamber through the pressure equalization tube into the upper part of the water storage tank during steam ironing. The steam is at a temperature of about 100° Celsius. Consequently, the upper part of the steam iron, particularly the handle, is heated to such an extent that the handling of the steam iron is greatly affected and the number of materials from which the handle can be manufactured is reduced considerably.

In order for the pressure equalization to operate satisfactorily, the tank in known steam irons must be tightly sealed during steam ironing so as to prevent pressure equalization with the atmosphere. A leaky sealing mechanism or a fill opening which is not quite closed will cancel out the effect of pressure equalization entirely.

SUMMARY OF THE INVENTION

According to the invention there is provided a steam iron including a water storage tank, an evaporation chamber to provide steam for ironing, a drip valve for regulating the flow of water from the tank into the pressure chamber connected to the evaporation chamber for pressure equalization therewith, the pressure chamber being connected to receive water from the tank via a non-return valve and being connected to feed water to said evaporation chamber via said drip valve.

Thus during steam ironing the same pressure conditions prevail in the pressure chamber at the inlet end of the drip valve and in the evaporation chamber at the outlet end of the valve, while only the pressure chamber, rather than the water storage tank as a whole, is pressurized and heated by being connected to the evaporation chamber. It is, therefore, possible to avoid excessive heating of the upper part of the iron, particularly the handle, and furthermore the interior of the tank may be connected directly to atmosphere.

In a preferred embodiment the pressure chamber is connected to the evaporation chamber via a pressure equalization passage and to the interior of the water storage tank via a non-return valve. The interior of the water storage tank is connected to atmosphere. As a result, during steam ironing, only the pressure chamber is heated by the steam. Consequently, only the water inside the pressure chamber reaches a temperature of about 100° C., while the water in the water storage tank is heated only to about 60° C. The water storage tank, the handle area and the cover of the tank thus remain cool. As a result, less expensive thermoplastics may be used to construct the steam iron. The water storage tank need not be made of metal but may be made from a thermoplastic synthetic material. Moreover, an even ironing temperature is obtained over the entire soleplate, since the water supplied to the evaporation chamber from the pressure chamber is already at a temperature of about 100° C. Consequently, less heat of evaporation is taken from the soleplate at the drip point. Since the pressure equalization takes place only between the pressure chamber and the evaporation chamber, there is no need for any additional sealing mechanism for closing the fill opening of the water storage tank. During steam ironing, with the drip valve open, water is conveyed from the pressure chamber into the evaporation chamber and here converted from a liquid into steam. As a result of the pressure equalization, overpressure prevails within the pressure chamber, to keep the non-return valve closed against the hydrostatic pressure of the column of water in the tank. If the pressure chamber is empty, the overpressure in the pressure chamber falls briefly. As a result, water is able to flow from the water storage tank into the pressure chamber via the non-return valve and the pressure chamber is refilled from the water storage tank. This process is repeated until either the drip valve is closed or the water storage tank is empty. A flap secured at one end is fully adequate as a non-return valve.

Preferably a valve rod is provided for actuating the drip valve from outside the water storage tank.

Preferably a pressure equalization passage connects the pressure chamber and the evaporation chamber, and another non-return valve is provided between the pressure equalization passage and the pressure chamber. This prevents water from flowing out of the pressure chamber through the pressure equalization passage and the evaporation chamber when the iron is in an inclined position.

BRIEF DESCRIPTION OF THE DRAWING

An embodiment of the invention will now be described by way of example and with reference to the accompanying drawing which shows a diagrammatic section through part of a steam iron.

DESCRIPTION OF THE PREFERRED EMBODIMENT

The partial view of the steam iron shown in the drawing shows part of a soleplate 16, an evaporation chamber 18 and a heating element 15. The evaporation chamber 18 is sealed off by a cover 14. A water storage tank 1 is arranged above the evaporation chamber 18. The tank 1 is connected to the evaporation chamber 18 via a short feed pipe 13. Inside the water storage tank 1 is a pressure chamber 7 which is connected to the evaporation chamber 18 via a pressure equalization passage or tube 11. Water is supplied from the tank 1 to the pressure chamber 7 through a non-return valve 8. The non-return valve 8 consists of a flap which is secured at one end, as at 9, to a housing 5 of the pressure chamber 7. In use, water is conveyed from the pressure chamber 7 through a drip valve 12 into the evaporation chamber 18. An actuating knob 2 is connected to a valve rod 3 which is connected to a valve needle 6, and by operating the knob 2 so as to move the rod 3 in the direction of the arrow, the flow of water through the drip valve 12 is regulated. The valve rod 3 is sealingly guided in the housing 5 of the pressure chamber 7. Between the pressure equalization tube 11 and the pressure chamber 7 there is another non-return valve 4, so that even when the iron is held in an inclined position it is impossible for water to flow out of the pressure chamber 7 via the tube 11 and into the evaporation chamber 18.

The water storage tank 1 is filled through the fill opening 10. The pressure chamber 7 is also filled through the non-return valve 8. The element 15 can then be switched on and, for steam ironing, the drip valve 12 is opened. Water flows through the drip valve 12 from the pressure chamber 7 into the evaporation chamber 18 where it is evaporated. Due to the pressure equalization tube 11, the pressure now built up here also prevails in the pressure chamber 7 and the non-return valve 8 is closed. The pressure chamber 7 remains closed until all the water contained in the pressure chamber 7 has been conveyed into the evaporation chamber 18 and as a result the overpressure in the pressure chamber 7 has fallen. Water then flows again into the pressure chamber 7 out of the water storage tank 1 which communicates with the atmosphere. This process is repeated until the drip valve 12 is closed or the tank 1 is empty. Due to the preferred construction of the pressure chamber 7 the water flows evenly out of the chamber 7 into the evaporation chamber 18.

Modifications to the specific embodiment of the steam iron and to any broad aspects thereof referred to or suggested herein may be apparent to those skilled in the art and the disclosure hereof is extended to encompass any such modifications.

What is claimed as new and desired to be secured by Letters Patent of the United States is:

1. A steam iron including a water storage tank, an evaporation chamber to provide steam for ironing, a drip valve for regulating the flow of water from the tank into the evaporation chamber, there being within the tank a pressure chamber connected to the evaporation chamber for pressure equalization therewith, the pressure chamber being connected to receive water from the tank via a non-return valve and being connected to feed water to said evaporation chamber via said drip valve.

2. A steam iron claimed in claim 1, including a pressure equalization passage connecting said pressure chamber and said evaporation chamber, a non-return valve being provided between the pressure equalization passage and the pressure chamber.

3. A steam iron as claimed in claim 1, including a valve rod for actuating the drip valve from outside the water storage tank.

4. A steam iron as claimed in claim 1, wherein the evaporation chamber is connected to the soleplate of the iron.

* * * * *